US006415017B1

(12) United States Patent
Kohda

(10) Patent No.: US 6,415,017 B1
(45) Date of Patent: Jul. 2, 2002

(54) SCATTERED RAY ABSORPTION GRID

(75) Inventor: Katsuhiro Kohda, Kaisei-machi (JP)

(73) Assignee: Fuji Photo Film Co., Ltd., Kanagawa-Ken (JP)

( * ) Notice: Subject to any disclaimer, the term of this patent is extended or adjusted under 35 U.S.C. 154(b) by 0 days.

(21) Appl. No.: 09/964,340

(22) Filed: Sep. 28, 2001

(30) Foreign Application Priority Data

Sep. 28, 2000 (JP) ..... 2000-297009

(51) Int. Cl.[7] ..... G21K 1/00

(52) U.S. Cl. ..... 378/154; 378/145

(58) Field of Search ..... 378/154, 145; 250/505.1; 430/4

(56) References Cited

U.S. PATENT DOCUMENTS 4,362,807 A * 12/1982 Sato ..... 430/275.1
5,384,817 A * 1/1995 Crowther et al. ..... 378/145
5,418,833 A * 5/1995 Logan ..... 378/154
6,018,566 A * 1/2000 Eberhard et al. ..... 378/145

* cited by examiner

*Primary Examiner*—David P. Porta
*Assistant Examiner*—Pamela R. Hobden
(74) *Attorney, Agent, or Firm*—Sughrue Mion, PLLC

(57) ABSTRACT

A scattered ray absorption grid enhancing a scattered ray absorption property without increasing costs is provided. A grid portion of the scattered ray absorption grid is constituted by use of plate members obtained in such a manner that a powder containing tungsten 50% by weight or more is hardened with a binder so that the powder has a spatial filling rate of 40% or more.

11 Claims, 23 Drawing Sheets

SCATTERED RAY ABSORPTION GRID

BACKGROUND OF THE INVENTION

1. Field of the Invention

The present invention relates to a scattered ray absorption grid, more particularly to a scattered ray absorption grid having a plurality of plate members for constituting a grid formed by use of powders made of a radiation absorption material.

2. Description of the Related Art

A scattered ray absorption grid has been heretofore known, which is disposed between a subject for photography and a radiation detector and obtains radiation with a high S/N ratio by absorbing a scattered ray scattered by the subject for photography when an image is photographed by a radiographic imaging device.

This scattered ray absorption grid is constituted by arranging a plurality of plate members at intervals, which constitutes a grid portion. Each of the plate members for constituting a grid is formed by a slender and thin plate made of a material absorbing radiation. The scattered ray absorption grid absorbs radiation which is scattered by the subject for photography and travels obliquely, and effectively transmits only radiation from a radiation source which is made to be incident directly onto the radiation detector through the subject for photography. Thus, noise due to the detected scattered radiation mixed into an image of the subject for photography are reduced.

A high radiation absorption property is required for the plate members constituting the grid portion. In other words, a material having a high density must be used for the plate members, and generally a material obtained by processing lead to a thin plate shape is used.

SUMMARY OF THE INVENTION

As such a material for the plate members for constituting a grid having a high density, tantalum (Ta) and tungsten (w) are preferable from the viewpoint of the radiation absorption property, and it is known that tungsten (W) has a particularly excellent radiation absorption property.

However, tungsten has a high degree of hardness and an extremely high melting point, and is difficult to process. Accordingly, it is difficult to process tungsten to a slender and thin plate member for the grid, and said processing, if performed, would be quite high in cost.

The present invention was made in consideration of the foregoing circumstances. The object of the present invention is to provide a scattered ray absorption grid which is low in cost and has excellent scattered ray absorption property.

A scattered ray absorption grid of the present invention is composed of a grid portion constituted by use of plate members formed in such a manner that powders containing tungsten 50% by weight or more are hardened with binder so that the powders show a spatial filling rate of 40% or more, more preferably 60% or more. Alternatively, the scattered ray absorption grid of the present invention is composed of a grid portion constituted by use of plate members formed in such a manner that, grid materials formed by hardening powders containing tungsten 50% by weight or more with binder so that the powders show a spatial filling rate of 40% or more, more preferably 60% or more, are arranged on a substrate.

Furthermore, the foregoing powder containing tungsten 50% by weight or more means the one containing tungsten 50% by weight or more regardless of an existence state of tungsten such as tungsten compound including tungsten alloy, and tungsten mixture in which tungsten and other substances are physically mixed. Specifically, for example, even powder formed of only calcium tungstate $CaWO_4$ that is tungsten compound is included in the foregoing powder containing tungsten 50% by weight or more because this powder contains tungsten W 50% by weight or more. The foregoing powder containing tungsten 50% by weight or more includes powder formed of an alloy containing tungsten and other metals, for example, an alloy formed of tungsten W and lead Pb, if this powder contains tungsten 50% by weight or more. Furthermore, if powder formed of pure tungsten W and substance containing no tungsten contains tungsten 50% by weight or more, this powder is included in the foregoing powder containing tungsten 50% by weight or more, as a matter of course. In addition, if powder formed of tungsten compound, pure tungsten and substance containing no tungsten contains tungsten W 50% by weight or more, this powder is included in the foregoing powder containing tungsten 50% by weight or more.

As the tungsten compound, besides the foregoing calcium tungstate $CaWO_4$, enumerated are, for example, iron tungstate $FeWO_4$, lithium tungstate $LiWO_4$, magnesium tungstate $MgWO_4$, barium tungstate $BaWO_4$, sodium tungstate $Na_2WO_4$, nickel tungstate $NiWO_4$, lead tungstate $PbWO_4$, tungsten boride $W_2B$, WB and $W_2B_5$, tungsten carbide WC and $W_2C$, tungsten oxide WO, $W_2O_3$, $WO_2$ and $W_2O_5$, tungsten sulfide $WS_2$ and $WS_3$, tungsten silicide $WSi_2$, $WSi_3$ and $W_2Si_3$ and the like. As other metals forming the alloy together with the foregoing tungsten, enumerated are, for example, Co, Pt, Ni, Fe, Mo, Cr, Fe, Ti and the like in addition to the foregoing lead.

The foregoing binder should be an organic binder or a metal with a melting point less than the melting point of tungsten.

Furthermore, the binder, in the case that a body is formed by use of powder and the like as a main raw material, refers to a substance blended into the powder to maintain a shape of the body and to enhance the structural integrity thereof.

The aforementioned metal refers to those including alloys, and a metal showing a high density and an excellent radiation absorption property should be employed.

As the organic binder, for example, resin materials should be used so that particles constituting the powder are bound and the powder can maintain a stable shape.

It is not always necessary that the particles constituting the powder contain tungsten at a constant rate. Therefore, each of the particles can contain a different amount of tungsten as long as the powders as a whole contain a predetermined amount of tungsten.

A slender and thin plate extending in one direction should be used as the plate member for constituting a grid.

The inventor of the present invention made various investigations concerning the radiation absorption property of the plate member for constituting a grid, which was formed by hardening tungsten powder with a binder. As a result of these investigations, the inventor learned that a plate member for constituting a grid that shows an excellent radiation absorption property could be obtained when the amount of tungsten contained in the powder is set to 50% by weight or more and when a spatial filling rate in constituting the plate member by use of the powder is set to 40% or more, more preferably 60% or more. Based on this knowledge, the inventor arrived at the present invention.

According to the scattered ray absorption grid of the present invention, the grid portion is constituted by use of plate members formed by hardening powder made of tungsten, which is relatively low in cost and has an excellent radiation absorption property, with a binder, or alternatively the grid portion is constituted by use of plate members formed in such a manner that grid materials obtained by hardening the tungsten powders with the binder are arranged on a substrate. Therefore, the processing of the plate members for constituting a grid is very easy, and a productivity of the grid portion made of tungsten is enhanced. Accordingly, the scattered ray absorption grid can be obtained at low cost.

If an organic binder is used as the binder, it is possible to form the plate members for constituting a grid more easily, for example, by kneading the tungsten powders into a binder which was melted at a relatively low temperature and by molding the mixture of the tungsten powders and the binder. Accordingly, costs of the scattered ray absorption grid can be further reduced.

In the case where a metal having a melting point less than the melting point of tungsten is used as the binder, if lead which has an excellent radiation absorption property is, for example, used as the binder, the radiation absorption property of the plate members for constituting a grid obtained by hardening the tungsten powders with the binder can be further enhanced.

DESCRIPTION OF THE PREFERRED EMBODIMENTS

Embodiments of a scattered ray absorption grid of the present invention will be described hereunder with reference to the accompanying drawings.

Figure 1:
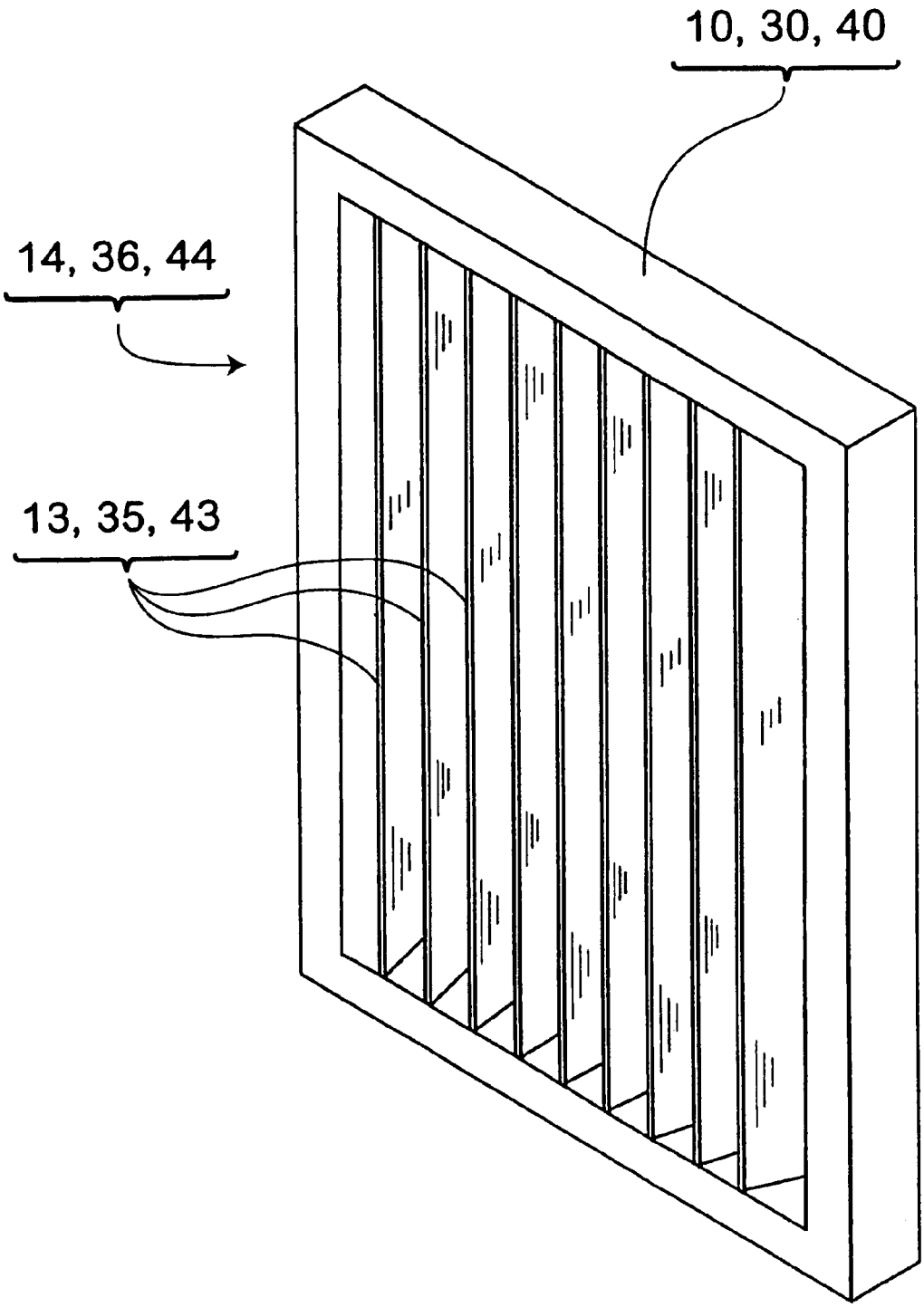
FIG. 1 is a drawing showing a schematic constitution of a scattered ray absorption grid of an embodiment of the present invention.

FIG. 1 is a drawing showing a schematic constitution of the scattered ray absorption grid common to first to tenth embodiments of the present invention.

<First Embodiment>

Figure 2:
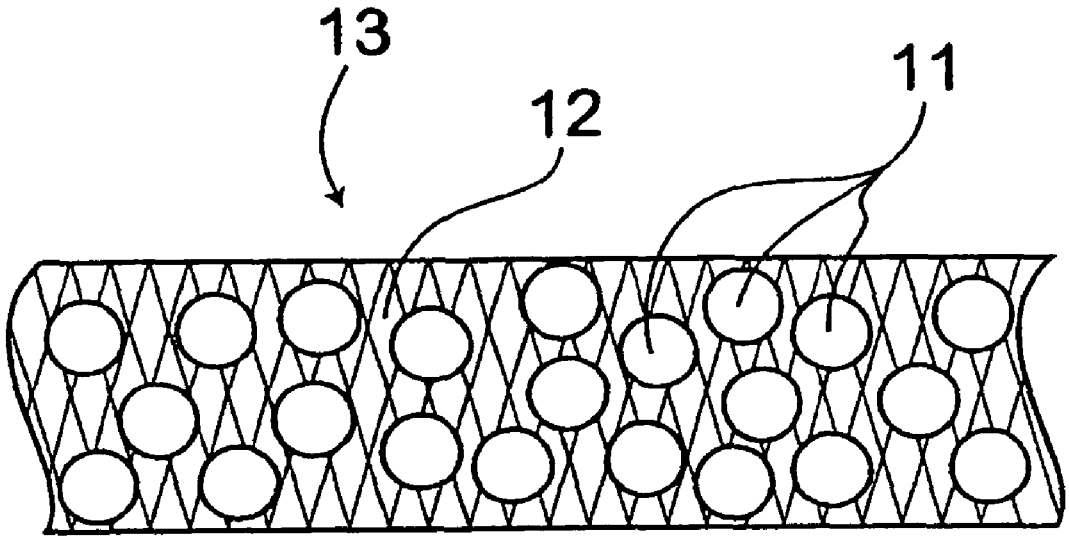
FIG. 2 is a drawing showing a schematic constitution of a plate member for constituting a grid of the scattered absorption grid of the first embodiment.

FIG. 2 is a section view showing a schematic constitution of one of plate members for constituting the scattered ray absorption grid of the first embodiment.

The scattered ray absorption grid 10 of the first embodiment is composed of a grid portion 14 (see FIG. 1) constituted by a plurality of plate members 13, which are formed by hardening powder 11 containing tungsten 50% by weight with binder 12 so as to have a spatial filling rate of40%. Each of the plate members for constituting a grid is manufactured by the following manufacturing steps in which tungsten and a polymer resin that is an organic binder (binder) are thermally kneaded, injected into a mold, and then cooled.

First, 250 grams of thermoplastic polyurethane resin, which is an organic binder of pellet shape that has a melting point of 120° C., was mixed into 5 kg of tungsten powder which have an average particle diameter of 7$\mu$ and contains tungsten 50% by weight. The mixture was dried at 110° C. for three hours and dehydrated.

Figure 3:
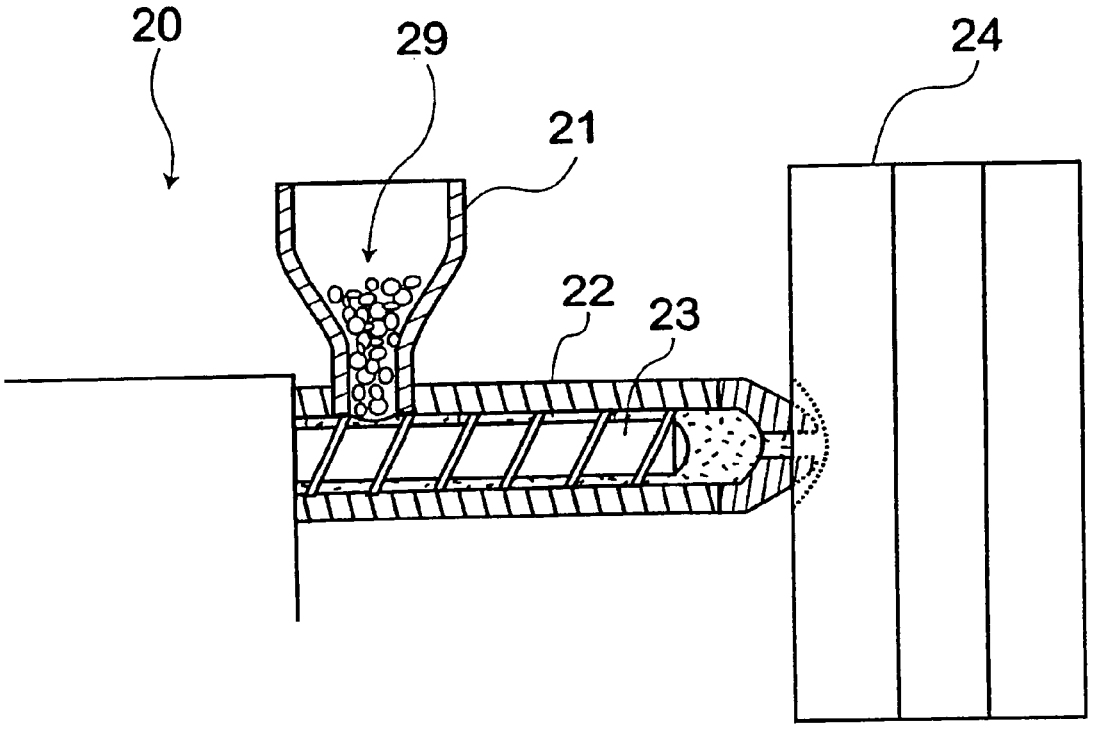
FIG. 3 is a drawing showing a state where the plate member for constituting a grid is molded in a molding machine.

Next, as shown in FIG. 3, the mixture 29 made of the pellet-shaped polyurethane resin and the tungsten powder was placed in a hopper 21 of a molding machine 20 and heated to 180° C. in a barrel 22 of the molding machine 20 to be fluidized. Then, the mixture was kneaded by a rotation of a screw 23.

Thereafter, the mixture made of the polyurethane resin and the tungsten powder that was fluidized in the barrel 22 was injected into a mold 24 for a grid.

Figure 4:
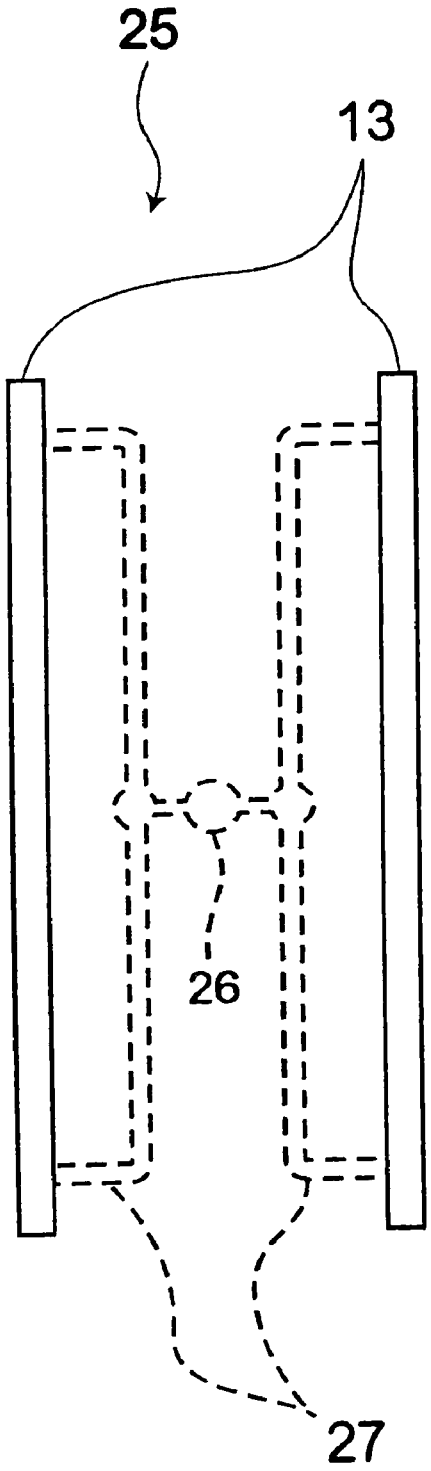
FIG. 4 is a drawing showing a mold product molded.

Then, the mixture made of the polyurethane resin and the tungsten powder injected into the mold 24 for a grid was cooled, and a mold product 25 as shown in FIG. 4 was taken out of the mold 24 for a grid. A spool 26 and a runner 27 were removed from the mold product 25, and one of slender and thin plate-shaped plate members 13 for constituting a grid having a thickness of 0.1 mm, a width of 10 mm, and a length of 440 mm was obtained, in which the tungsten powders were hardened with the polyurethane resin so as to have a spatial filling rate of 40%.

Thereafter, the scattered ray absorption grid 10 was assembled using these plate members 13, and a good scattered ray absorption property was obtained.

<Second Embodiment>

Figure 5:
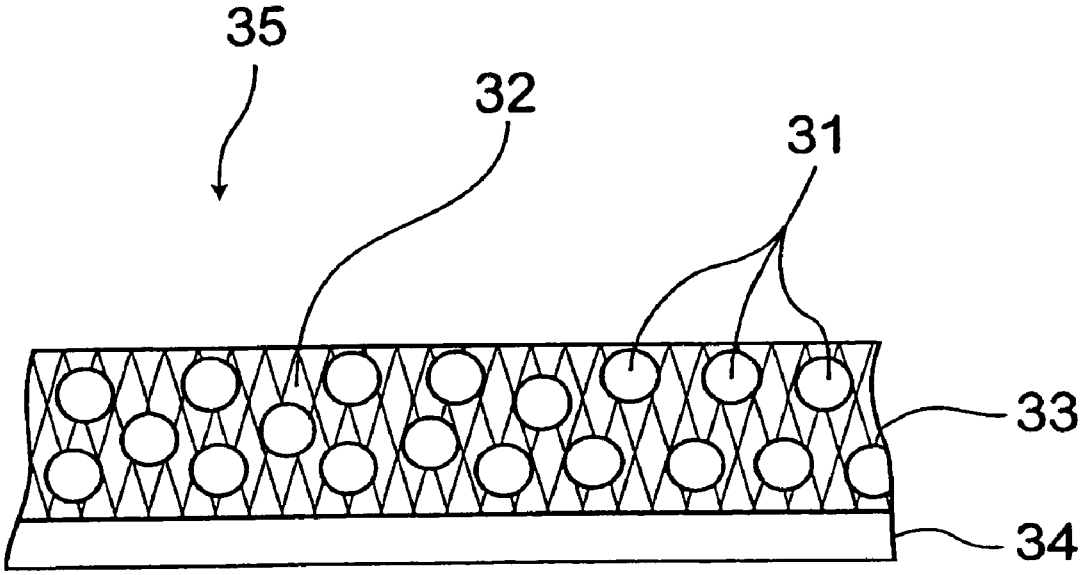
FIG. 5 is a drawing showing a schematic constitution of a plate member for constituting a grid of the scattered ray absorption grid of a second embodiment of the present invention.

FIG. 5 is a sectional view showing a schematic constitution of one of the plate members of which the scattered ray absorption grid of a second embodiment of the present invention is constituted. FIG. 1 shows a schematic constitution of the scattered ray absorption grid 30 of the second embodiment which is constituted by use of a plurality of plate members.

The scattered ray absorption grid 30 according to the second embodiment comprises a grid portion 36 (see FIG. 1) which is constituted by use of a plurality of plate members 35. Each of the plate members 35 for constituting a grid is constituted by arranging, on a substrate 34, a tungsten layer 33 formed by hardening a powder containing tungsten 50% by weight with a binder 32 so that the powder acquires a spatial filling rate of 40%. The plate member 35 is manufactured by the following manufacturing steps in which tungsten powder is dispersed in a solution obtained by allowing a polymer resin, which is an organic binder (binder), to dissolve into an organic solvent, and then this tungsten powder solution is coated on a polymer film to be a substrate and dried.

First, 150 grams of an unsaturated polyester resin (Byron 300 made by Toyobo Co. Ltd.), which is an organic binder, was added to 5 kg of tungsten powder, which have an average particle diameter of 7$\mu$ and contain tungsten 50% by weight.

Next, methyl ethyl ketone was added to the tungsten powder solution while agitating the tungsten powder solution by a propeller mixer, and an adjustment was made so that the solution had a viscosity of 20 poise.

Thereafter, the tungsten powder solution was coated on polyethylene A terephthalate (PET) resin of a film state having a thickness of 20$\mu$, which is a substrate, and the tungsten powder solution coated on the PET resin substrate 34 was dried.

Then, each of the plate members 35 for constituting a grid was obtained in such a manner that on the first layer made of the film-shaped PET resin substrate 34, the tungsten layer 33 that is a second layer material obtained by hardening tungsten powder with an unsaturated polyester resin so that the tungsten powder shows a spatial filling rate of 40% was laminated, thus obtaining a thin plane having a thickness of 0.1 mm. And, a slender plate member having a width of 10 mm and a length of 440 mm was cut out from said plane.

Thereafter, when the scattered ray absorption grid 30 was assembled by use of the plurality of plate members 35 for constituting a grid, a good scattered ray absorption property was obtained.

<Third Embodiment>

Figure 6:
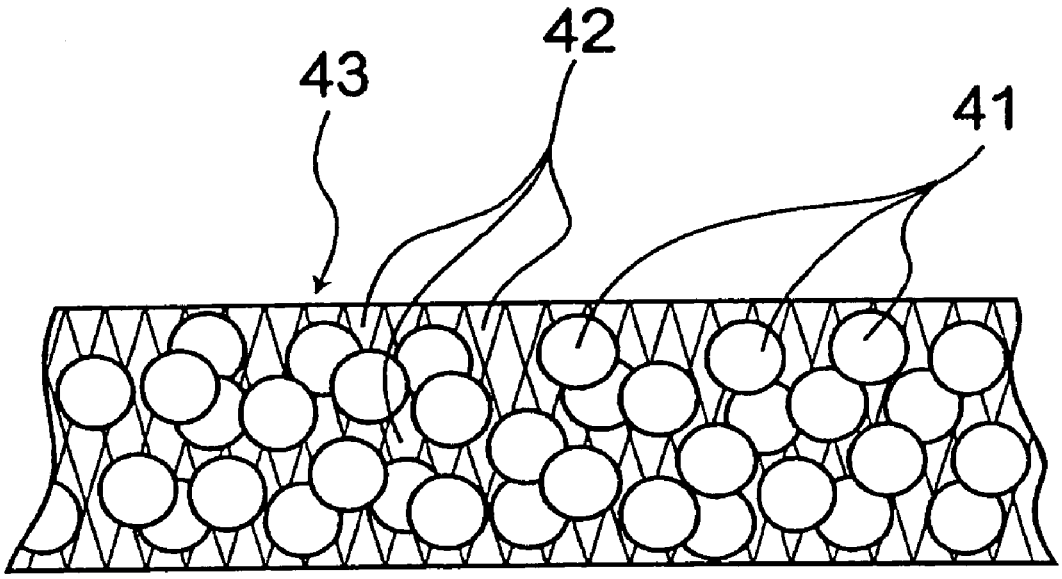
FIG. 6 is a drawing showing a schematic constitution of a plate member for constituting a grid of the scattered ray absorption grid of a third embodiment of the present invention.

FIG. 6 is a sectional view showing a schematic constitution of one of the plate members for constituting a grid by which the scattered ray absorption grid of a third embodiment of the present invention is constituted. FIG. 1 shows a schematic constitution of the scattered ray absorption grid 40 of the third embodiment which is constituted by use of a plurality of plate members.

The scattered ray absorption grid 40 according the third embodiment is composed of a grid portion 44 (see FIG. 1) constituted by use of a plurality of plate members 43, which are formed by hardening tungsten powder 41 containing tungsten 60% by weight with a binder 42 so as to show a spatial filling rate of 50%. Each of the plate members 43 for constituting a grid is manufactured by the following manufacturing steps in which tungsten powder 41 and lead solder (an alloy with lead and tin as main constituents) which acts as a binder are thermally kneaded, and extruded through a thin rectangular slit, thus obtaining each of the plate members for constituting a grid.

First, 1700 grams of lead solder was mixed into 5 kg of tungsten powder. The tungsten powder have an average particle diameter of 7$\mu$ and contain tungsten 60% by weight; and the lead solder is particle-shaped binder having a melting point of 22020 C. which is less than that of tungsten.

Figure 7:
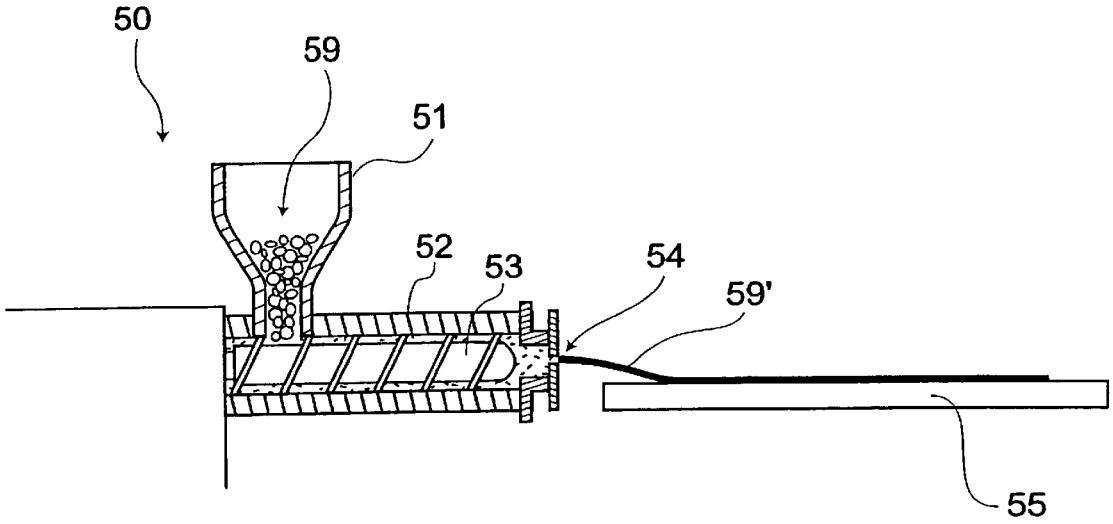
FIG. 7 is a drawing showing a state where the plate member for constituting a grid is molded by a pushing-out machine.

Next, as shown in FIG. 7, the mixture 59 described above was placed in a hopper 51 of an extrusion machine 50 and heated to 250° C. in a barrel 52 to be fluidized. Then, the mixture was kneaded by a screw 53.

Thereafter, the mixture of the lead solder and the tungsten powders in the barrel 52, which was fluidized, was continuously extruded onto a stainless steel plate 55 from a thin rectangular slit 54 having a width of about 0.1 mm.

The mixture 59' of the lead solder and the tungsten powder which had been extruded onto the stainless steel plate 55 was then cooled, and a slender plate material having a width of 10 mm and a length of 440 mm was cut out from a thin plane having a thickness of 0.1 mm. Thus, each of the plate members 43 for constituting a grid was obtained.

Thereafter, when the scattered ray absorption grid 40 was assembled by use of the plurality of plate members 43 for constituting a grid, a good scattered ray absorption property was obtained.

<Fourth Embodiment>

Figure 8:
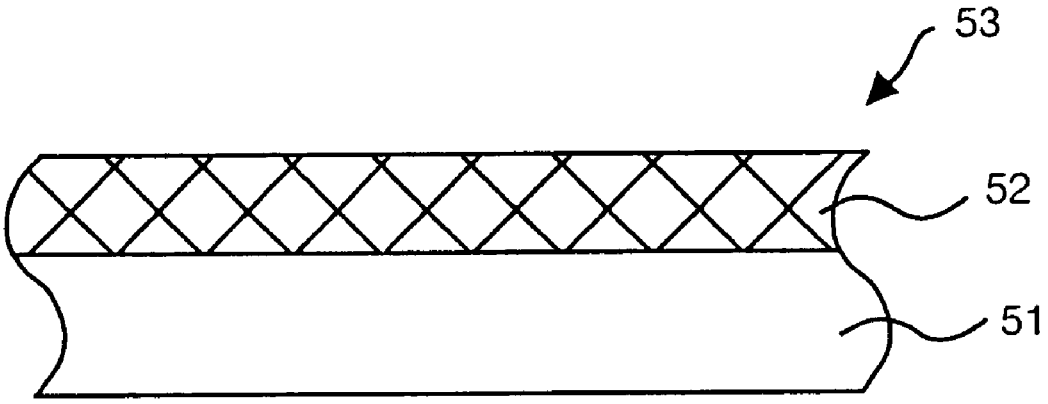
FIG. 8 is a section view showing a schematic constitution of a first original sheet for a plate member of a fourth embodiment.

FIG. 8 is a section view showing a schematic constitution of a first original sheet for a plate member, which constitutes a scattered ray absorption grid of a fourth embodiment of the present invention. A schematic constitution of the scattered ray absorption grid of the fourth embodiment of the present invention is shown in FIG. 1, which is constituted by use of the plate members for constituting a grid, which are cut out from the first original sheet for the plate member. Note that, the original sheet for the plate member means a material before being cut out from the original sheet to a predetermined shape as the plate member for constituting a grid.

While agitating solution with a propeller mixer, in which polyurethane resin of 130 g that is an organic polymer binder was added to powder of 5 kg formed of tungsten showing a purity of 99%, which has an average particle size of 5 $\mu$m, an adjustment was made so that tungsten powder solution shows a viscosity of 20 P by adding methyl ethyl ketone to this substance.

Thereafter, this tungsten powder solution was coated on a film-shaped PET resin substrate 51 having a thickness of 180 $\mu$m, which is made of polyethylene terephthalate (PET) resin and serves as a substrate. The tungsten powder solution coated on the PET resin substrate 51 was dried, thus forming a tungsten layer 52 of a thickness of 100 $\mu$m, which shows a spatial filling rate of 62%. Thus, the first original sheet 53 for the plate member was obtained (see FIG. 8).

Thereafter, by cutting out a slender plate member from this first original sheet 53 for the plate member, which has a width of 10 mm and a length of 440 mm, a plate member 54 for constituting a grid was obtained (see FIG. 1), and a scattered ray absorption grid 50 was assembled by use of many of the plate members 54 for constituting a grid. Thus, a good scattered ray absorption property was obtained.

<Fifth Embodiment>

Figure 9:
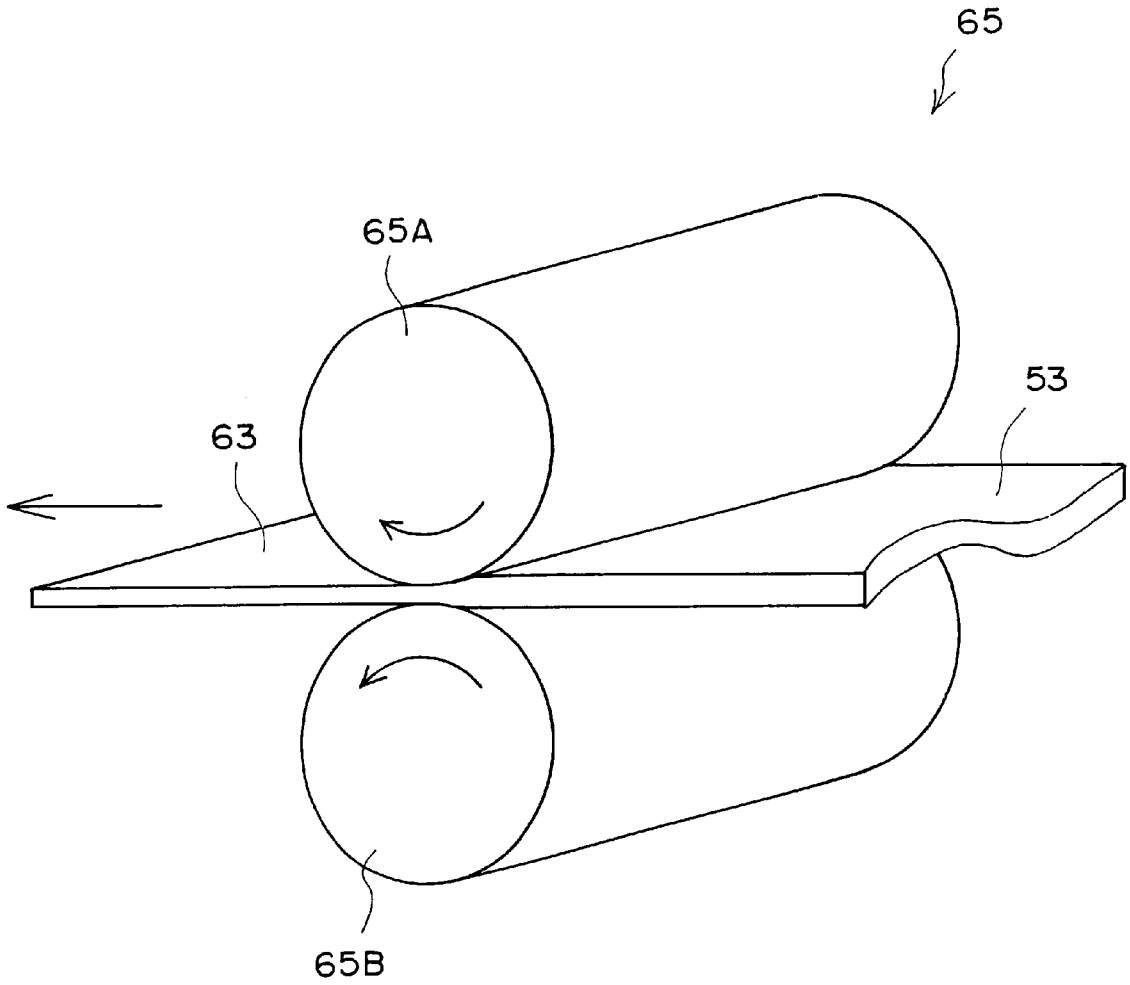
FIG. 9 is a perspective view showing a schematic constitution of a calendar roll used in a fifth embodiment.
Figure 10:
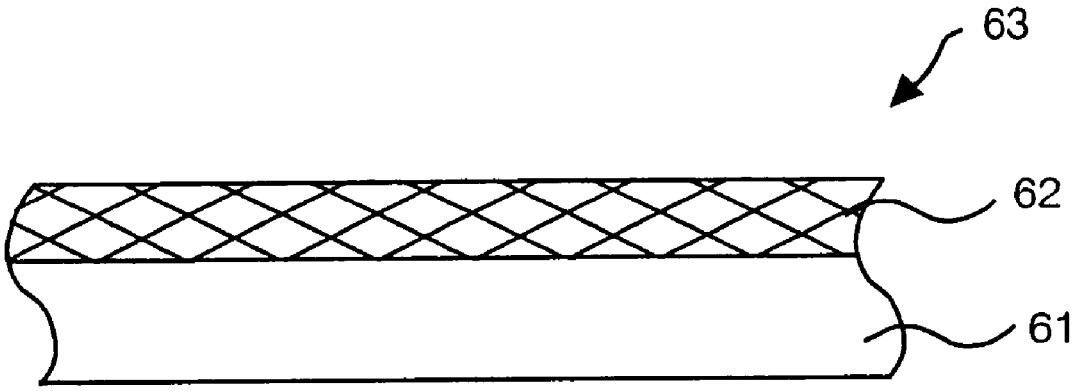
FIG. 10 is a section view showing a schematic constitution of a second original sheet for a plate member.

FIG. 9 is a perspective view showing a schematic constitution of a calendar roll used for manufacturing a second original sheet for a plate member, which constitutes a scattered ray absorption grid of a fifth embodiment of the present invention. FIG. 10 is a section view showing a schematic constitution of the second original sheet for the plate member. A schematic constitution of the scattered ray absorption grid of the fifth embodiment of the present invention is shown in FIG. 1, which is constituted by use of the plate members for constituting a grid, which are cut out from the second original sheet for the plate member.

As shown in FIG. 9, the first original sheet 53 for the plate member manufactured by the same steps as those in the fourth embodiment was allowed to pass through a calendar roll 65 comprising a thermal compression rolls 65A and 65B, whereby the first original sheet 53 for the plate member was thermally compressed at temperature of 70° C. and at pressure of 50 MPa. Thus, the second original sheet 63 for the plate member (see FIG. 10) was obtained, in which a tungsten layer 62 of a thickness of 90 $\mu$m showing a spatial filling rate of 70% was laminated on a PET resin substrate 61.

Thereafter, a plate member 64 for constituting a grid was obtained by cutting out a slender plate member from the second original sheet 63 for the plate member, which has a width of 10 mm and a length of 440 mm. A scattered ray absorption grid 60 was assembled by use of many of the plate members 64 for constituting a grid. A good scattered ray absorption property was obtained.

<Sixth Embodiment>

Figure 11:
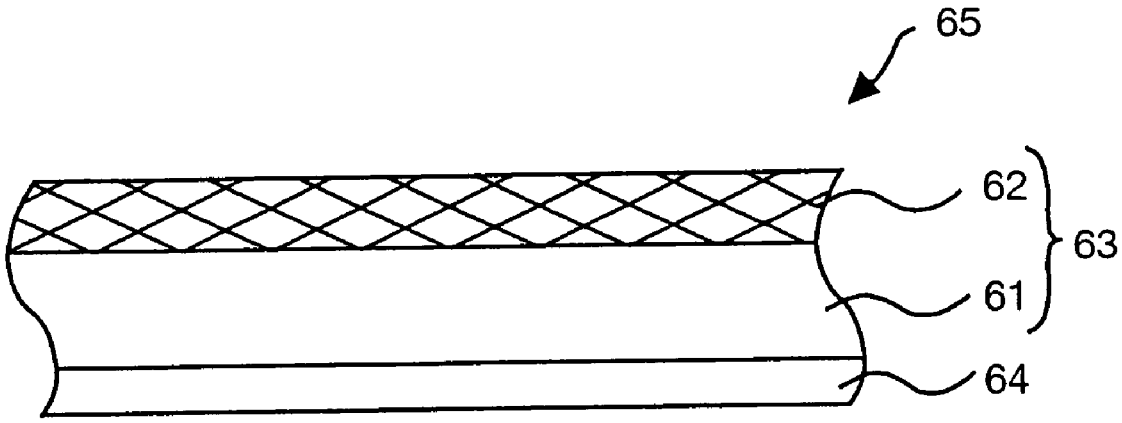
FIG. 11 is a section view showing a schematic constitution of a third original sheet for a plate member of a sixth embodiment.
Figure 12:
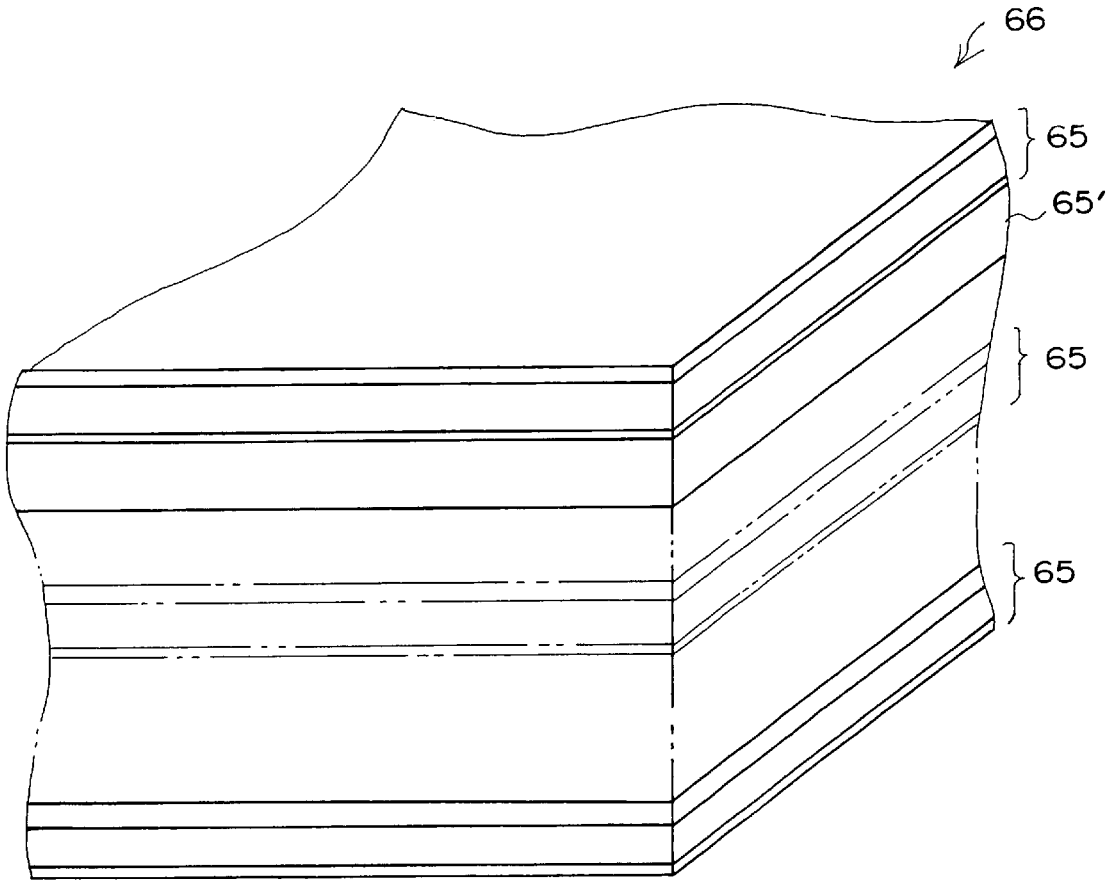
FIG. 12 is a perspective view showing a lamination block body.
Figure 13:
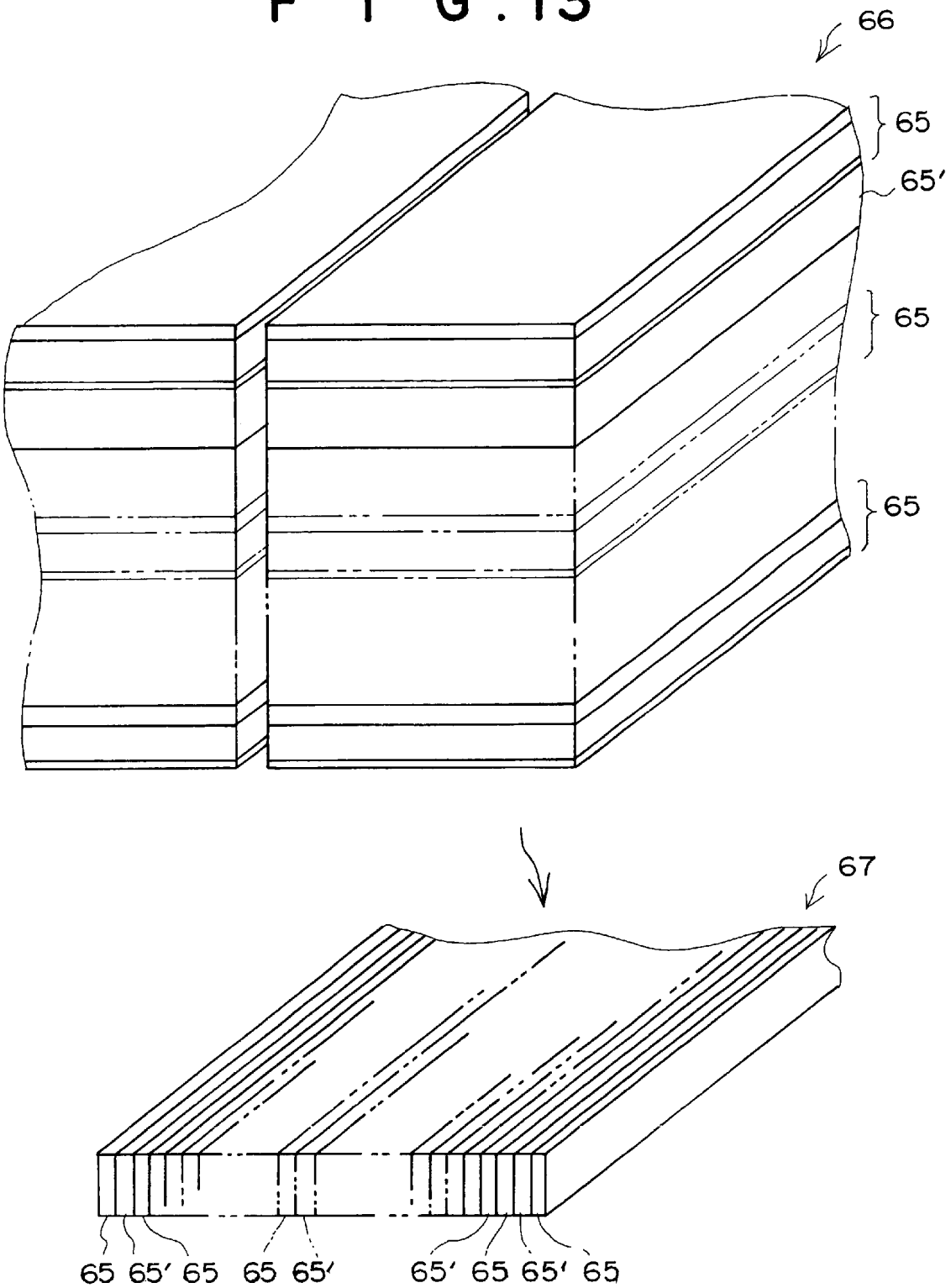
FIG. 13 is a perspective view of a lamination cut body obtained by slicing the lamination block body.
Figure 14:
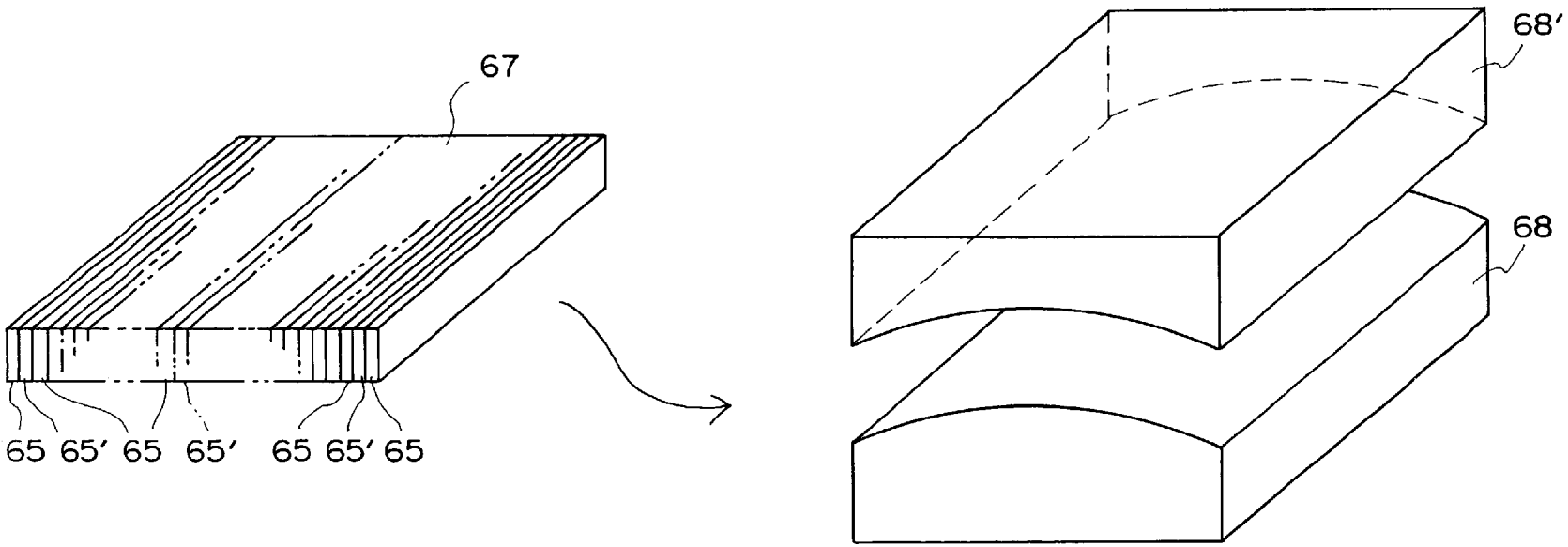
FIG. 14 is a drawing showing a state where the lamination cut body is held by sandwiching the lamination cut body between a concave block and a convex block.
Figure 15:
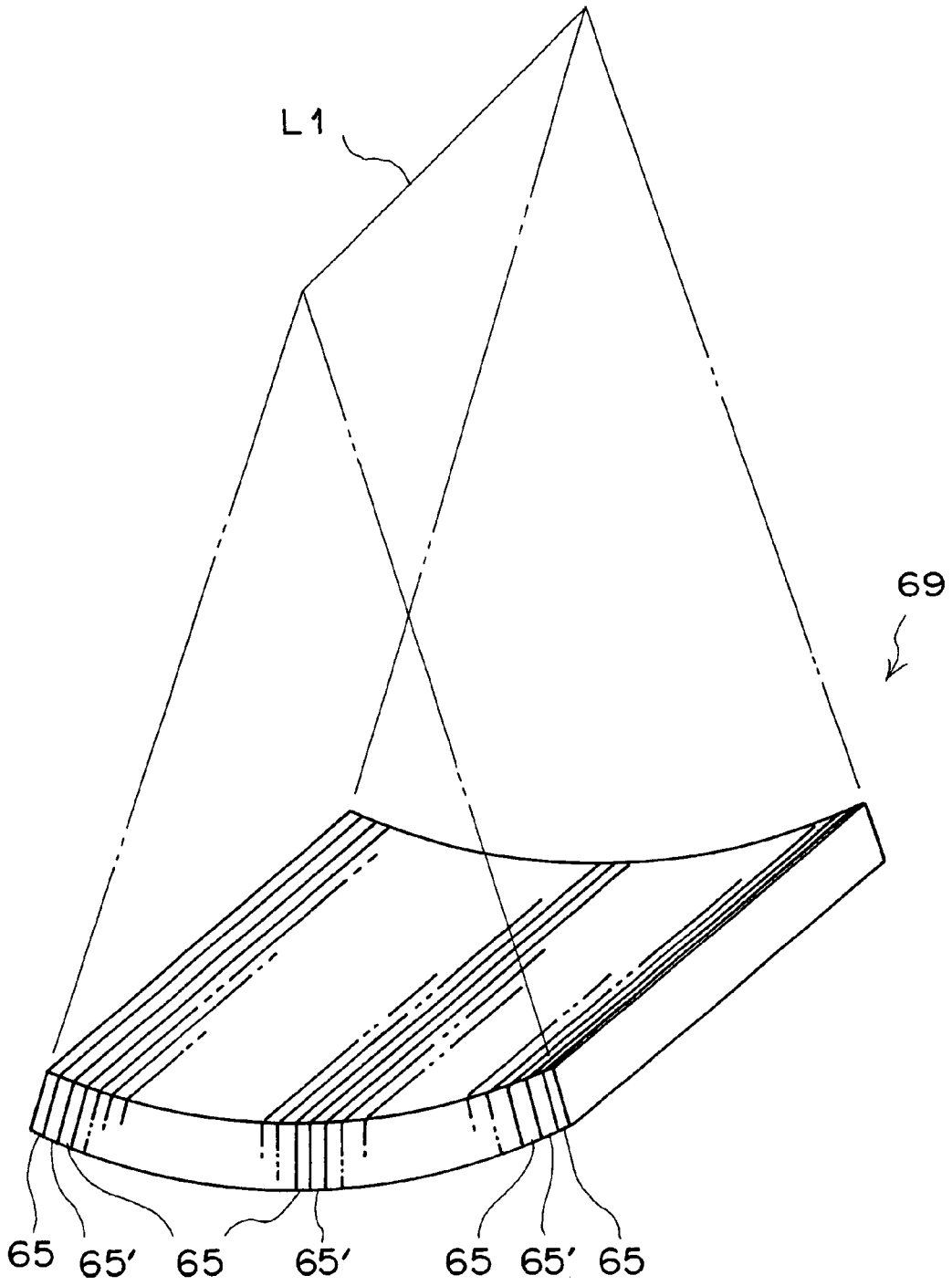
FIG. 15 is a drawing showing a scattered ray absorption grid of a sixth embodiment of the present invention.

FIG. 11 is a section view showing a schematic constitution of a third original sheet for a plate member, which constitutes a scattered ray absorption grid of a sixth embodiment of the present invention. FIG. 12 is a perspective view showing a lamination block body formed by laminating the plurality of third original sheets for the plate member so as to be superposed upon another. FIG. 13 is a perspective view showing a state where the lamination block body is sliced thus acquiring a lamination cut body. FIG. 14 is a drawing showing a state where the lamination cut body is sandwiched between a convex block and a concave block, thus holding the lamination cut body therebetween. FIG. 15 is a drawing showing the scattered ray absorption grid of the sixth embodiment of the present invention.

First, as shown in FIG. 11, a line-shaped adhering layer 64 made of polyester resin was coated by a thickness of 10 $\mu$m on the PET resin substrate 61 opposite to the tungsten layer 62 of the original sheet 63 for the plate member, which was obtained in the fifth embodiment. Thus, an original sheet 65 for a plate member was formed.

Next, as shown in FIG. 12, the foregoing original sheet 65 for the plate member and a resin spacer 65' having the same shape as that of the original sheet 65 and a different thickness from that of the original sheet 65 were alternately superposed upon another in plural number. A lamination body formed in such a manner was kept in atmosphere at temperature of 90° C. and at pressure of 20 MPa for 50 minutes, and then cooled, thus forming a lamination block body 66.

Next, as shown in FIG. 13, this lamination block body 66 is sliced by use of a band saw to a width of 5 mm, and a cross section of the lamination block body 66 cut by the band saw was polished. Thus, a lamination cut body 67 was obtained.

Next, as shown in FIG. 14, this lamination cut body 67 was sandwiched between a semicylindrical convex block 68 made of aluminum and a concave block 68' having a shape obtained by transferring the semicylindrical shape thereto, and kept in atmosphere of temperature of 90° C. for 50 minutes, followed by cooling. Then, the lamination cut body 67 was taken out therefrom.

Thus, a scattered ray absorption grid 69 having a radius of curvature of 1.8 m in which a center of curvature of an arc-shaped curved surface converges on the straight line L1 as shown in FIG. 15 was obtained, and this scattered ray absorption grid 69 showed a good scattered ray absorption property.

<Seventh Embodiment>

Figure 16:
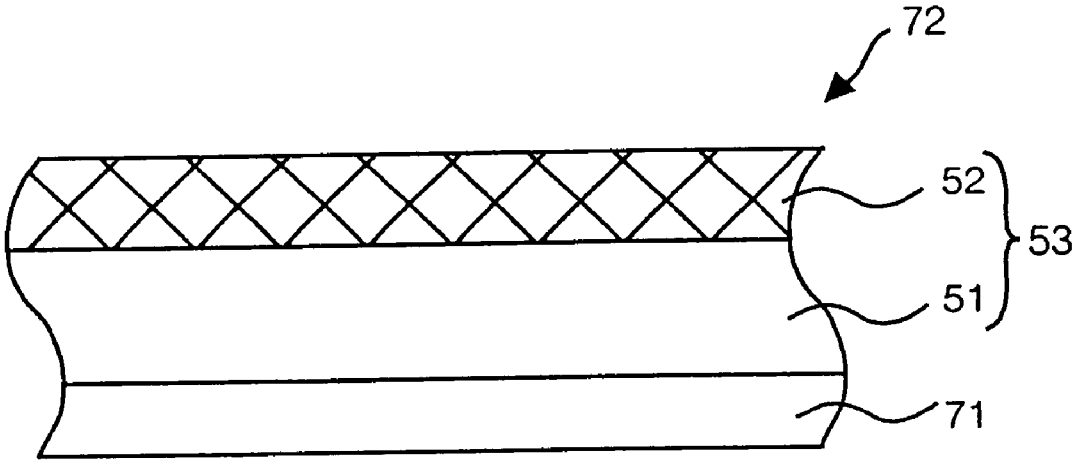
FIG. 16 is a section view showing a schematic view of a fourth plate member for constituting a grid of a seventh embodiment.
Figure 17:
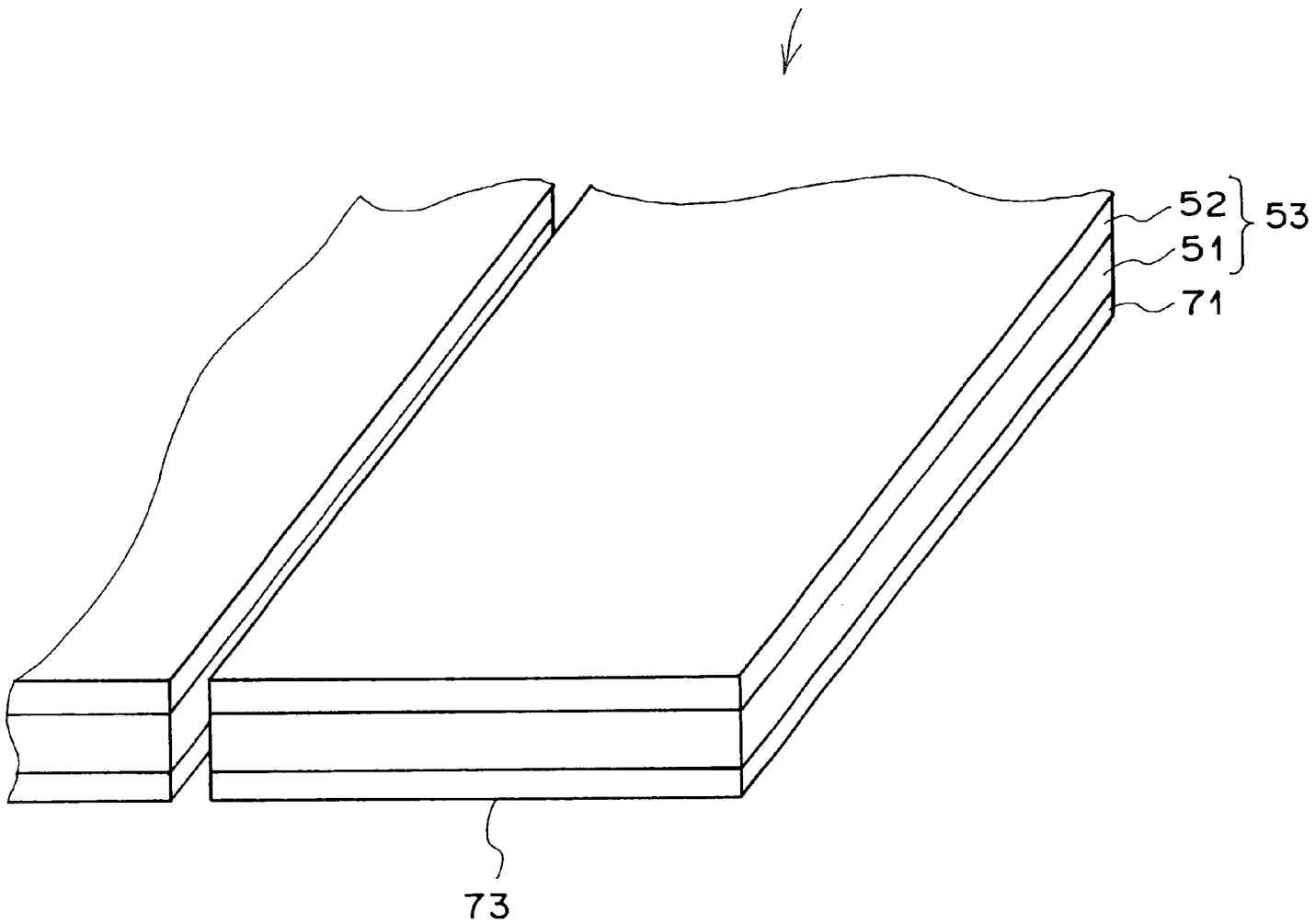
FIG. 17 is a perspective view of a rectangular material for constituting a grid.
Figure 18:
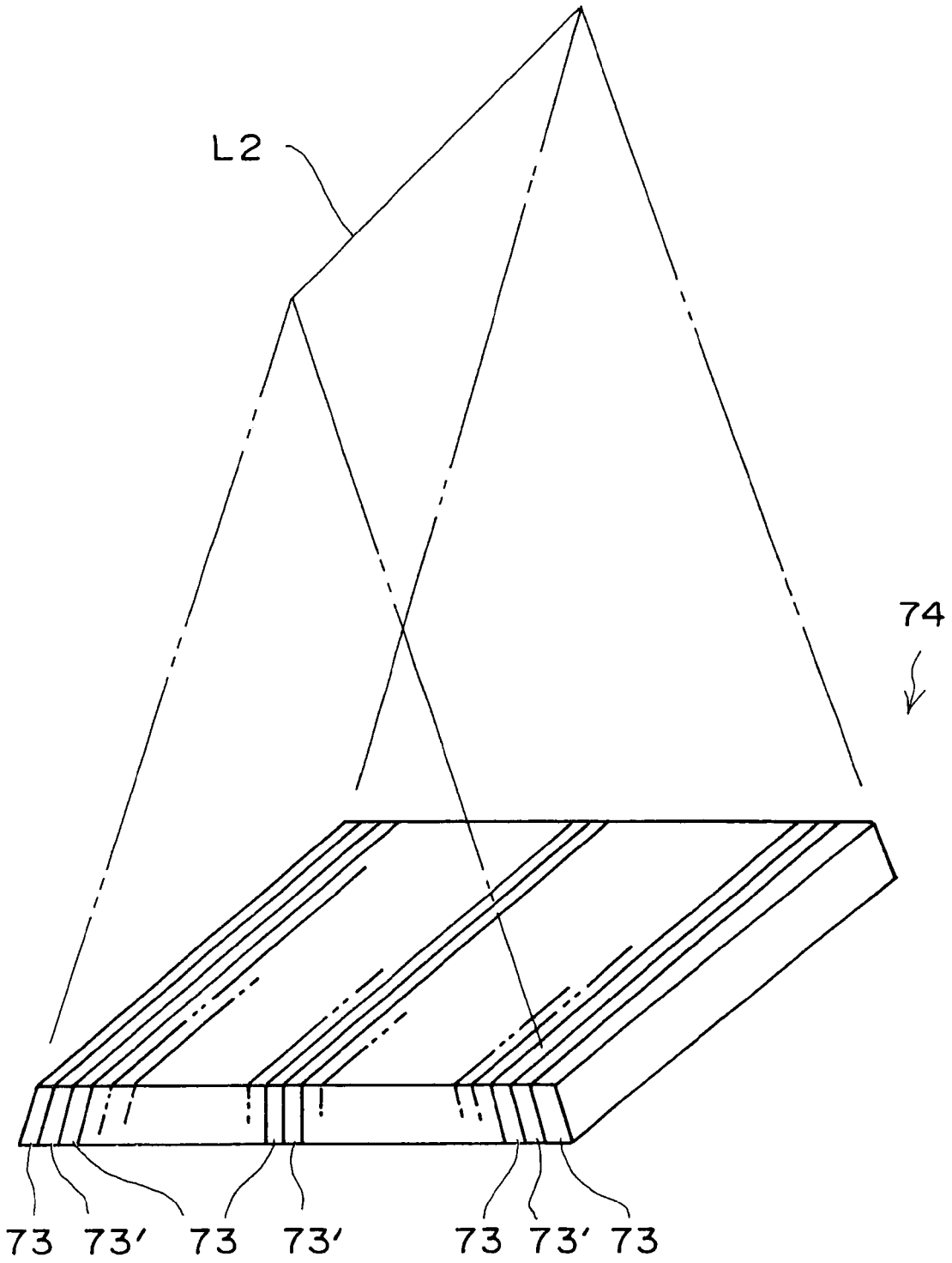
FIG. 18 is a perspective view of a rectangular block body for constituting a grid.
Figure 19:
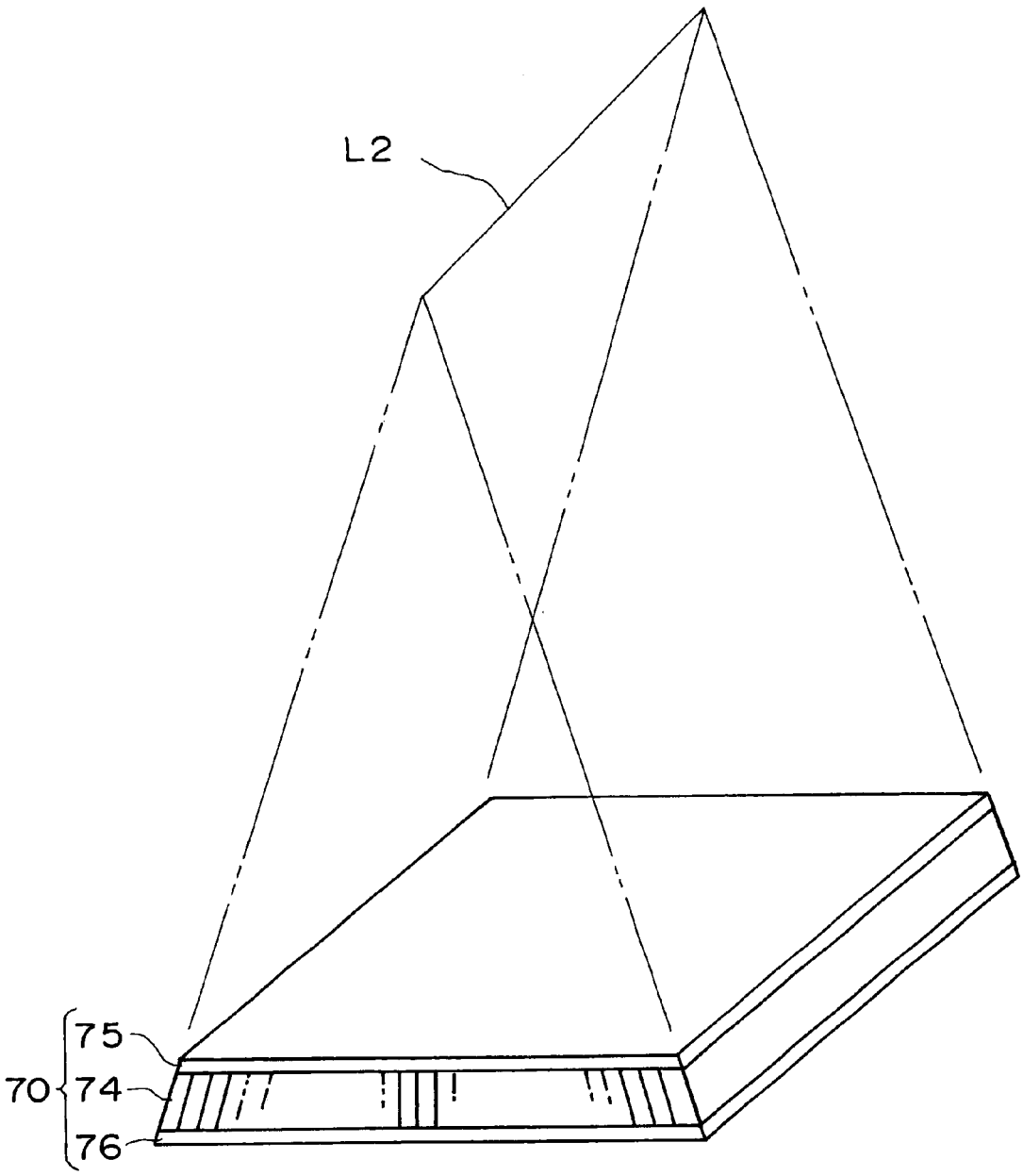
FIG. 19 is a perspective view of a scattered ray absorption grid of the seventh embodiment.

FIG. 16 is a section view showing a schematic constitution of a fourth plate member for constituting a grid, which constitutes a scattered ray absorption grid of a seventh embodiment of the present invention. FIG. 17 is a perspective view of a rectangular material for constituting a grid obtained by cutting the fourth plate member for constituting a grid. FIG. 18 is a perspective view of a rectangular block body for constituting a grid, which is formed by arranging the rectangular materials for constituting a grid and adhering them to each other. FIG. 19 is a perspective view of the scattered ray absorption grid of the seventh embodiment of the present invention, which is formed by adhering a top plate and a lower plate to the rectangular block body for constituting a grid.

First, as shown in FIG. 16, line-shaped polyester resin was coated on the PET resin substrate 51 opposite to the tungsten layer 52 of the first original sheet 53 for the plate member manufactured by the same steps as those in the fourth embodiment, thus laminating a line-shaped polyester resin adhering layer 71 of a thickness of 40 $\mu$m thereon. Thus, a fourth original sheet 72 for a plate member was prepared.

This fourth original sheet 72 for the plate member was cut to be a rectangular shape having a width of 5 mm, thus obtaining a rectangular material 73 for constituting a grid as shown in FIG. 17. The rectangular material 73 for constituting a grid and a resin spacer 73' having the same shape as that of the material 73 and a different thickness from that of the material 73 were alternately arranged and sequentially adhered to each other so that directions of rectangular surfaces of the materials 73 having a width of 5 mm converge on the straight line L2 apart from the materials 73 by 1.8 m as shown in FIG. 18. Thus, a rectangular block body 74 for constituting a grid was formed. Note that, when the rectangular material 73 and the resin spacer 73' were adhered, each rectangular material 73 and each resin spacer 73' were made to be inclined so as to converge on the line L2 by allowing an adhering layer of a thickness of 40 $\mu$m to flow, and fixedly adhere to each other.

Next, a top plate 75 and a lower plate 76 which have a thickness of 0.3 mm were adhered respectively to a converging side and a diverging side of the rectangular material 73 for constituting a grid which constitutes the foregoing rectangular block body 74 for constituting a grid.

Thus, a scattered ray absorption grid 70 as shown in FIG. 19 was obtained, in which each of the rectangular materials 73 is arranged so as to converge toward the line L2 apart therefrom by 1.8 m. This scattered ray absorption grid 70 showed a good scattered ray absorption property.

<Eighth Embodiment>

Figure 20:
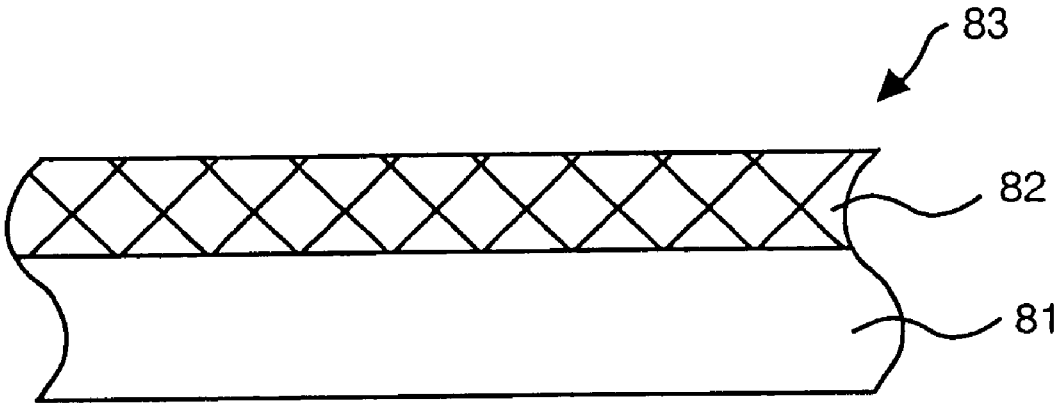
FIG. 20 is a section view showing a schematic constitution of a fifth original sheet for a plate member of an eighth embodiment.

FIG. 20 is a section view showing a schematic constitution of a fifth original sheet for a plate member, which constitutes a scattered ray absorption grid of an eighth embodiment of the present invention. In FIG. 1, shown is a schematic constitution of the scattered ray absorption grid of the eighth embodiment of the present invention, which is constituted by use of plate members for constituting a grid, which are cut out from the fifth original sheet for the plate member.

While agitating solution obtained by adding polyurethane resin of 130 g to powder of 5 kg formed of tungsten carbide WC having an average particle size of 4 μm with a propeller mixer, methyl ethyl ketone was added to this substance, and a viscosity of the tungsten carbide powder solution was adjusted so as to be 20 P. The tungsten carbide is tungsten compound having a purity of 99%, and the polyurethane resin is an organic high polymer binder.

Thereafter, this tungsten carbide powder solution was coated on a film-shaped PET resin substrate 81 made of polyethylene terephthalate (PET) resin. The PET resin substrate 81 is a substrate having a thickness of 180 μm. The tungsten carbide powder solution coated on this PET resin substrate 81 was dried, thus forming a tungsten carbide layer 82 which has a spatial filling rate of 60% and a thickness of 150 μm. Thus, the fifth original sheet 83 for the plate member as shown in FIG. 20 was obtained.

Thereafter, a slender plate material having a width of 10 mm and a thickness of 440 mm was cut out from the fifth original sheet 83 for the plate member, whereby a plate member 84 for constituting a grid was obtained. A scattered ray absorption grid 80 was assembled by use of many of the plate members 84, and a good scattered ray absorption property was obtained.

<Ninth Embodiment>

Figure 21:
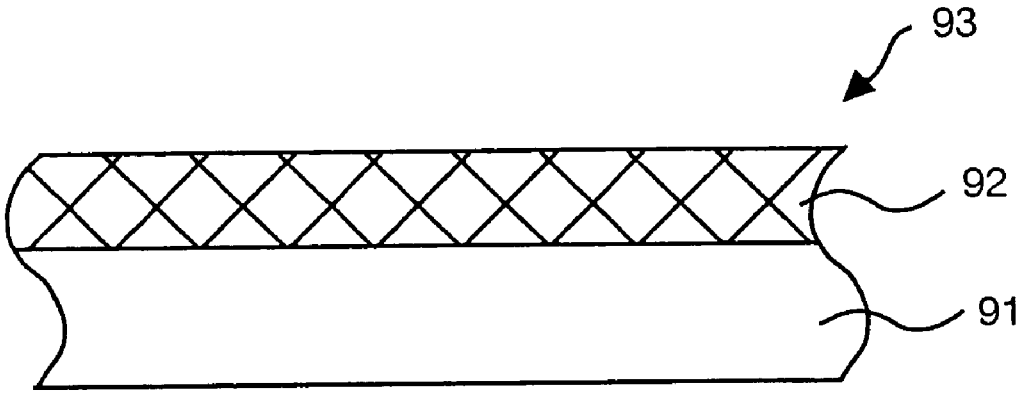
FIG. 21 is a section view showing a schematic constitution of a sixth original sheet for a plate member of a ninth embodiment.

FIG. 21 is a section view showing a schematic constitution of a sixth original sheet for a plate member which constitutes a scattered ray absorption grid of a ninth embodiment of the present invention. Furthermore, in FIG. 1, shown is the scattered ray absorption grid of the ninth embodiment of the present invention, which is constituted by use of plate members for constituting a grid cut out from the sixth original sheet for the plate member.

While agitating tungsten powder solution obtained by adding polyurethane resin of 80 g to powder with a propeller mixer, methyl ethyl ketone was added to this solution. The tungsten powder solution was prepared in such a manner that polyurethane resin, as an organic high polymer binder, of 80 g was added to powder obtained by mixing powder of 3.5 kg formed of tungsten having an average particle size of 5 μm and a purity of 99% with powder of 1.5 kg formed of tungsten having an average particle size of 1.5 μm and a purity of 99%. By the addition of the methyl ethyl ketone to the above tungsten powder solution, its viscosity was adjusted so as to be 20 P.

Thereafter, this tungsten powder solution was coated on a film-shaped PET resin substrate 91 having a thickness of 180 μm, which is made of polyethylene terephthalate (PET) resin and serves as a substrate. The tungsten powder solution coated on the PET resin substrate 51 was dried, thus forming a tungsten layer 92 of a thickness of 100 μm, which shows a spatial filling rate of 66%. Thus, the sixth original sheet 93 for the plate member was obtained (see FIG. 21).

Then, a slender plate material having a width of 10 mm and a thickness of 440 mm was cut out from the sixth original sheet 93 for the plate member, whereby a plate member 94 for constituting a grid was obtained. A scattered ray absorption grid 90 (see FIG. 1) was assembled by use of many of the plate members 94, and a good scattered ray absorption property was obtained.

<Tenth Embodiment>

Figure 22:
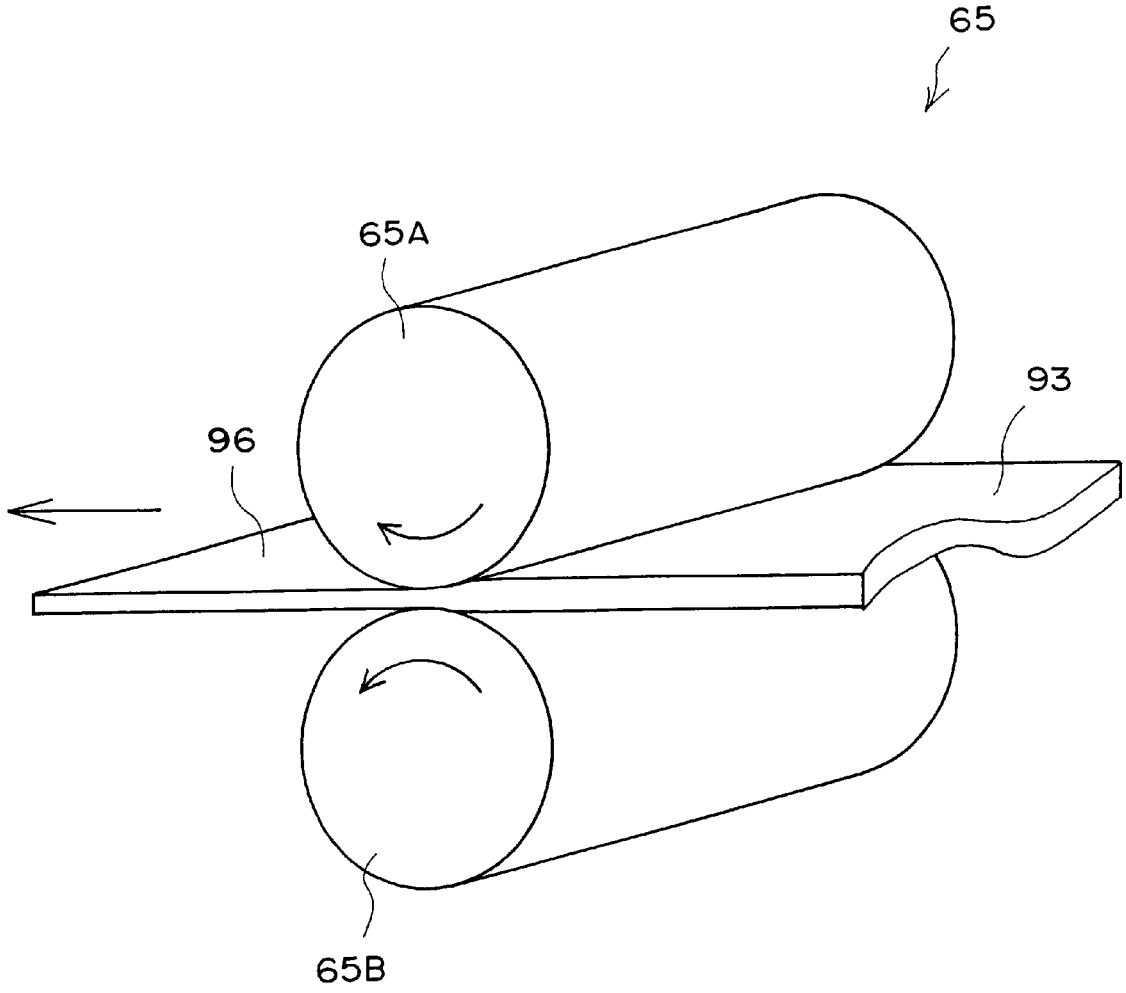
FIG. 22 is a perspective view showing a schematic constitution of a calendar roll used in a tenth embodiment.
Figure 23:
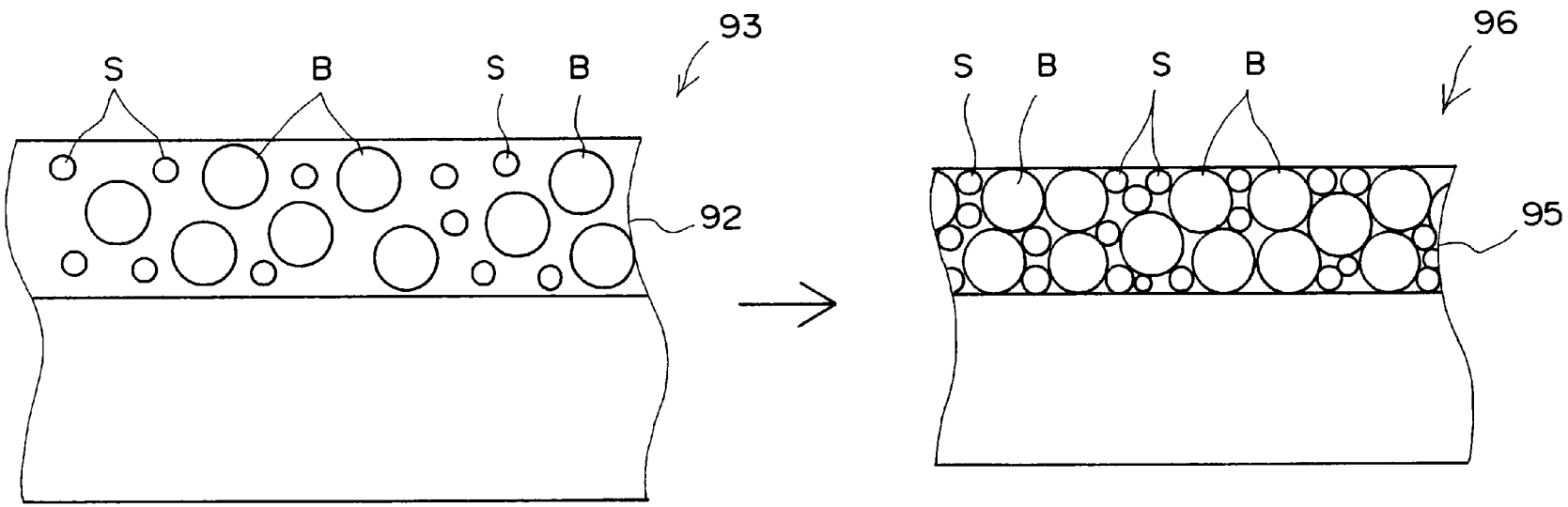
FIG. 23 is a conceptional view showing difference between filling densities of tungsten.

FIG. 22 is a perspective view showing a schematic constitution of a calendar roll used for manufacturing a seventh original sheet for a plate member, which constitutes a scattered ray absorption grid of a tenth embodiment of the present invention. FIG. 23 is a conceptional view showing a state where a filling density of tungsten in the seventh original sheet for the plate member is increased. A schematic constitution of the scattered ray absorption grid of the tenth embodiment of the present invention is shown in FIG. 1, which is constituted by use of the plate members for constituting a grid, which are cut out from the seventh original sheet for the plate member.

As shown in FIG. 22, the sixth original sheet 93 for the plate member manufactured by the same steps as those in the ninth embodiment was allowed to pass through a calendar roll 65 comprising a thermal compression rolls 65A and 65B, whereby the original sheet 93 was thermally compressed at temperature of 70° C. and at pressure of 50 MPa. Thus, the seventh original sheet 96 for the plate member, which has a tungsten layer 95 of a thickness of 92 μm showing a spatial filling rate of 72%, was obtained. As shown in FIG. 23, in the seventh original sheet 96 for the plate member, small particles S that are powders formed of tungsten having an average particle size of 1.5 μm enter between large particles B that are powders formed of tungsten having an average particle size of 5 μm, and the small particles S fill spatially between the large particles B effectively. Accordingly, it is possible to further increase the filling density of the tungsten in the tungsten layer 95 of the seventh original sheet 96 for the plate member compared to the tungsten layer 92 of the sixth original sheet 93 for the plate member.

Thereafter, a plate member 97 for constituting a grid was obtained by cutting out a slender plate member from the seventh original sheet 96 for the plate member, which has a width of 10 mm and a length of 440 mm. A scattered ray absorption grid 98 was assembled by use of many of the plate members 97. A good scattered ray absorption property was obtained.

In each of the foregoing embodiments, though the content of the tungsten in the powder and the spatial filling rate of the powder in the plate member formed by said powder are shown by numerical values, the content and the spatial filling rate are not limited to this range. When the scattered ray absorption grid is constituted either by use of the plate members for constituting a grid obtained by hardening the powder containing tungsten 50% by weight or more with the binder so that the powders show the spatial filling rate of 40% or more, or by use of the plate members obtained in such a manner that the powder containing tungsten 50% by weight or more are hardened with the binder so that the powders show the spatial filling rate of 40% or more, a good scattered ray absorption property is obtained similarly to the foregoing embodiments.

Furthermore, the spacer filled between the plate members for constituting a grid (13, 35, 43, 54, 64, 84, 94 and 97 in FIG. 1), which constitute the scattered ray absorption grid in the foregoing embodiments, should be the one which shows lessened X-ray absorption. For example, aluminum, wood, paper, cloth, resin, unwoven fabric and foaming resin can be used as the foregoing spacer.

According to the present invention as described above, the processing of the plate members for constituting a grid is very easy by using tungsten powder which has an excellent radiation absorption property, and productivity of the grid portion made of tungsten is enhanced. Accordingly, a scattered ray absorption grid which is relatively low in cost and shows an excellent scattered ray absorption property can be obtained.

What is claimed is:

1. A scattered ray absorption grid comprising:

a grid portion constituted by use of plate members formed in such a manner that a powder containing tungsten 50% by weight or more are hardened with a binder so that the powder has a spatial filling rate of 40% or more.

2. The scattered ray absorption grid according to claim 1, wherein said binder is organic binder.

3. The scattered ray absorption grid according to claim 2, wherein said organic binder is thermoplastic polyurethane resin.

4. The scattered ray absorption grid according to claim 1, wherein said binder is a metal with a melting point less than the melting point of tungsten.

5. The scattered ray absorption grid according to claim 4, wherein said metal is lead solder made of an alloy containing tin and lead as its main components.

6. A scattered ray absorption grid comprising;

a grid portion constituted by use of plate members for constituting a grid formed in such a manner that, grid materials formed by hardening a powder containing tungsten 50% by weight or more with a binder so that the powder has a spatial filling rate of 40% or more is coated on a substrate.

7. The scattered ray absorption grid according to claim 6, wherein said binder is organic binder.

8. The scattered ray absorption grid according to claim 7, wherein said organic binder is a polymer resin.

9. The scattered ray absorption grid according to claim 8, wherein said polymer resin is unsaturated polyester resin.

10. The scattered ray absorption grid according to claim 6, wherein said binder is a metal with a melting point less than the melting point of tungsten.

11. The scattered ray absorption grid according to one of claims 1 to 4, wherein said spatial filling rate is equal to 60% or more.

* * * * *